United States Patent [19]

Vollman et al.

[11] Patent Number: 4,827,541

[45] Date of Patent: May 9, 1989

[54] PRONE PATIENT POSITIONER

[76] Inventors: Kathleen M. Vollman, 820 Newport, Long Beach, Calif. 90804; Ronald G. Posa, 27260 Canfield #208, Dearborn Heights, Mich. 48127

[21] Appl. No.: 134,650

[22] Filed: Dec. 15, 1987

[51] Int. Cl.[4] ..... A61G 7/10

[52] U.S. Cl. ..... 5/61; 5/81 R; 5/82 R

[58] Field of Search ..... 5/61, 81 R, 82 R, 83, 5/89, 431, 435, 461, 468, 465, 446; 128/87 R

[56] References Cited

U.S. PATENT DOCUMENTS

| | | | |
|---|---|---|---|
| 1,667,982 | 5/1928 | Pearson | 5/61 |
| 2,417,378 | 3/1947 | Robinson | 5/82 |
| 2,803,022 | 8/1957 | Wynkoop | 5/435 |
| 4,054,960 | 10/1977 | Pettit et al. | 5/446 |

*Primary Examiner*—Gary L. Smith
*Assistant Examiner*—Michael F. Trettel
*Attorney, Agent, or Firm*—Bruce A. Jagger; Natan Epstein

[57] ABSTRACT

A prone patient positioner is provided which includes about four padded pylon members mounted on a beam or rail structure. The pylon members are positionable along the beams structure so as to provide a padded pylon at each of the patient's forehead, chin, upper chest and pelvic area. The prone patient positioner is strapped to and movable with the patient.

5 Claims, 1 Drawing Sheet

PRONE PATIENT POSITIONER

Figure 1:
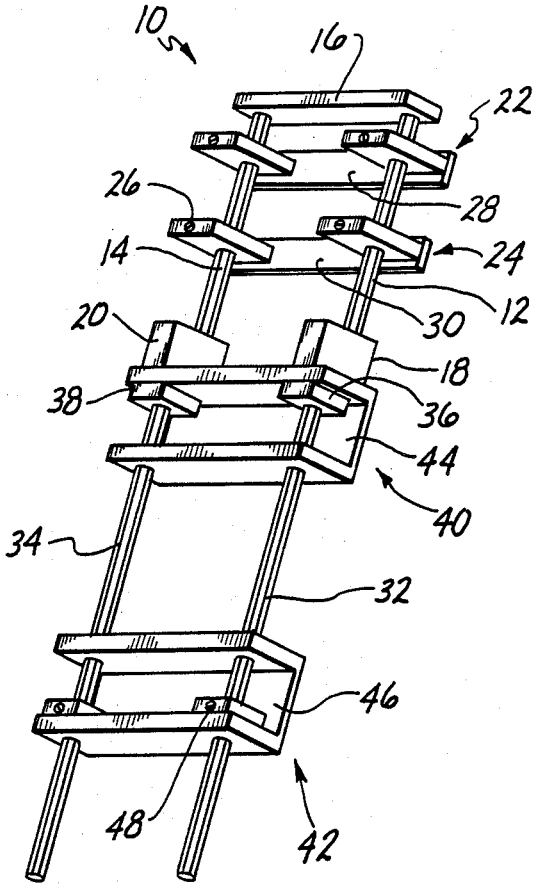

This invention relates to prone patient positioners and more particularly to prone positioners whereby the patient is supported on padded pylons in the face down prone position.

Previously considerable difficulty had been experienced in the physical positioning of patients and in particular respiratory patients. The mortality rate for respiratory patients with adult respiratory distress syndrome is approximately 70 percent. Positioning of patients with this problem is of vital concern to their very survival. Previous expedients for turning respiratory patients into the prone face down position included large and cumbersome equipment which required some considerable effort, expense and experience in setting up and using it. Prior devices generally included special beds which had power driven mechanisms for rotating the platform portion of the bed within some supporting framework. Such structures are expensive, cumbersome, present maintenance problems and requires some expertise and skill in their use. Bed-ridden patients with other diseases or infirmities often require that they be turned off of their backs to avoid forming bed sores. Supporting them safely and comfortably in the face down prone position has presented substantial difficulties similar to those encountered with respiratory problems.

These and other disadvantages of the prior art have been overcome according to the present invention. The present invention provides a plurality of separate padded pylon members which are mounted on a simple beam or rail structure. The rail or beam structure serves to hold the padded pylon members in a desired predetermined configuration with respect to one another. At least one of the padded pylon members is adjustable along the rail elements so as to accommodate patients of different heights and proportions. The padded pylon members are adjusted with respect to one another so that the patient is provided with support for the head, the upper part of the chest and the pelvic area. The padded pylon members are proportioned and positioned so that the stomach portion of the patient's anatomy is free of contact with both the pylons and the underlying substrate when the patient is in the prone position face down on the prone patient positioner. Suitable means, generally padded straps, are provided for securing the prone patient positioner to the patient. In general, the prone patient positioner is strapped to the patient while the patient is lying prone face up. The patient is then turned face down with the assistance of the structure which is provided by the prone positioner. The rail or beam members of the prone positioner generally provide convenient handles for grasping and using to turn the patient.

In general, patients who are in need of the aid of the prone patient positioner according to the present invention are encumbered with various apparatus and tubes so that the less structure there is in the prone patient positioner to interfere with this necessary equipment the better. For this reason and for reasons of lightness, expense, adjustability and general ease of use and utility, the pylons are preferably separate and independent from one another and only the minimum structure necessary to support the intended use of the device is provided.

In addition to facilitating breathing, and indeed, in some instances to make breathing possible, the device according the present invention permits the turning of a patient prone with very little difficulty. Turning a patient prone can be accomplished safely and quickly. The device can be set up and attached to the patient with a minimum of effort and skill. When the need for the device is over, it may be quickly removed, cleaned and reused with whatever adjustments in positioning of the pylons may be appropriate to accommodate another patient's size and proportions.

In general, the pylons are composed of a rigid portion and a padded portion. The rigid portion may be made of a suitable material such as a rigid engineering plastic. Plastics are preferred over metal because they are generally lighter, less expensive and are easy to clean.

The beam or rail structure is generally constructed of a metal such as stainless steel because of its strength and durability.

In general, a prone patient positioner according to the present invention is designed so that the beam or rail structure extends generally longitudinally of the patient from the region of the head towards the feet. The rigid portions of the pylons or blocks generally extend transversely of and are mounted on the beam or rail structure. At least some of the pylons are movable, longitudinally along the beam or rail structure so as to permit their positioning to accommodate a articular patient. The blocks or pylons are provided with detent means for securing them at the desired pre-determined location along the longitudinal axis of the beam or rail structure.

The pylons are provided with padding between the rigid portion of the pylon and the patient. The padding is thick enough to conform comfortably to the contours of the patient's body without allowing the patient to come into contact with the hard supporting structure of the pylon. In general, the pylon is of sufficient width to extend laterally across the patient's body so as to provide support from one side to the other. The pylon is generally of sufficient depth or height to suspend the patient at least four and preferably as much as 6 or 8 inches off of the bed or other underlying supporting substrate. The height and positioning of the pylons is such that the abdomen of the patient is suspended free of significant contact with both the pylons and the supporting substrate. This greatly facilitates the breathing of the patient, particularly when mechanical ventilation is being utilized.

Because of the light weight construction and portability of the patient prone positioner of the present invention, it is possible to move a patient from one location to another while strapped to the positioner, the open structure which is provided by the separate body support members or pylons together with the convenient handles provided by the structure permits a patient to be turned and moved easily and safely without disrupting the equipment which is attached to the patient.

The figures in the accompanying drawing have been provided for purposes of illustration only and not limitation.

Referring particularly to the drawings, there is illustrated:

FIG. 1, A perspective view of a preferred embodiment of the present invention without padding and strap members.

Figure 2:
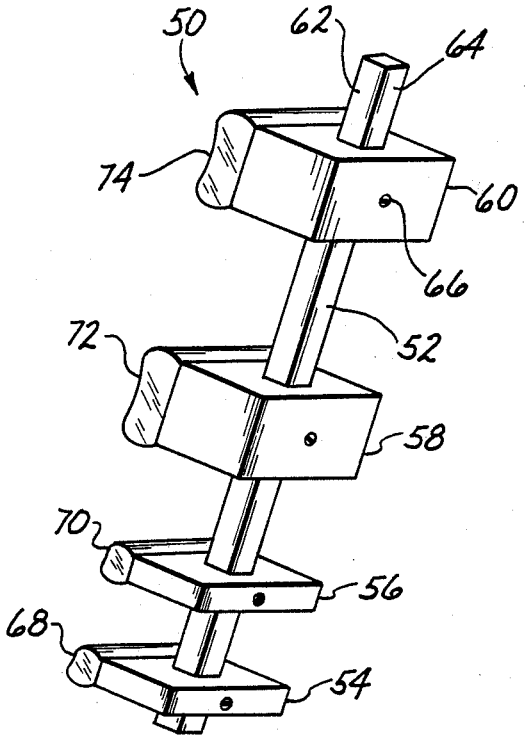
Figure 3:
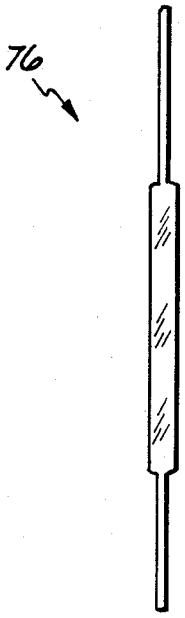

FIG. 2, A perspective view of a further embodiment of the present invention; and FIG. 3, A plan view of a padded strap for use with the present prone Referring particular to FIG. 1, there is indicated generally at 10 a prone patient positioner, including a pair of head rails 12 and 14 which are socketed at one longitudinal end in spacer block 16 and at the other longitudinal end in socket blocks 18 and 20. First head pylon or block 22 and second head pylon or block 24 are slidably mounted to and extend transversely of head rails 12 and 14. Each of the four ports through which the respective head rails pass is provided with a releasable detent means, a typical one of which is indicated, for example, at 26. These releasable detent means permit the first and second head pylons 22 and 24, to be adjusted to the desired operating positions and then locked in place. First head pylon 22 includes a platform 28 and second head pylon 24 includes a similar platform 30. The function of platforms 28 and 30 is to provide substantially rigid support for a pad which is not illustrated in this view. Body rails 32 and 34 are socketed at one longitudinal end in socket members 36 and 38. An upper torso pylon or block is indicated generally at 40. A pelvic pylon or block is indicated generally at 42. As with pylons 22 and 24, the block members 40 and 42 are illustrated for the sake of clarity without the padding in place. The upper torso and pelvic pylons 40 and 42 are generally U-shaped in configuration. The lower part of the U-shaped configuration is formed by platforms 44 and 46, respectively. The lower outer surfaces of platforms 44 and 46 are provided with suitable fastening means, not illustrated, by which padding may be attached thereto. Suitable fastening means include, for example, snaps and Velcro fasteners. The pelvic pylon 42 is positionable longitudinally along body rails 32 and 34. Detent or locking means are provided to secure the pelvic pylon 42 in the desired location relative to and spaced from upper torso pylon 40. A typical locking detent member is illustrated, for example, at 48.

Referring particularly to FIG. 2, there is illustrated generally at 50, a prone patient positioner which include a beam 52, head block members 54 and 56 and body block members 58 and 60. Beam 52 is provided with rail surfaces 62 and 64 as well as opposing rail surfaces which are not visible in FIG. 2. The four rail surfaces cooperate with mating rectangular passageways in the respective block members so as to position the separate block members at the desired locations along the longitudinal axis of beam 52 and prevent the rotation thereof about beam 52. Locking elements are provided in cooperation with each of the block members, illustrated, for example, at 66, for the purpose of releasably securing the block members in the desired operative positions on beam 52. Pads 68, 70, 72, and 74 are provided on the respective block members to support e patient's body weight on the separate pylons. The pads 68, 70, 72, and 74 are releasably secured to the matching surfaces of the block members so as to permit their removal and replacement for cleaning purposes.

Referring particularly to FIG. 3 there is indicated generally at 76 a padded strap. Padded strap 76 is adapted to be wrapped around the patient's body and fastened there in association with the respective pylon members so as to secure each pylon separately to the patient's body. The padded straps may be crossed between pylons over the patient's body if this is deemed desirable. This is sometimes preferred for securing the head in position.

The rail or beam structure is generally approximately four feet long. The body pylons are generally from approximately 14 to 20 inches wide, from approximately four to eight inches long, and from approximately four to eight inches in depth or height. The head pylons are generally approximately two inches long and of a depth sufficient to position the head comfortably with respect to the rest of the body. If desired the depth of the pylons may be made adjustable to accommodate wide variations in anatomy. Adjustments in depth may be accomplished, for example, by adjusting or replacing the rigid parts of the pylons or by varying the depth of the padding.

Various rail or beam structures may be used according to the present invention. Plural beam or rail structures generally provide a rigid structure and permit the individual ones of the beams to be lighter than is required when only a single beam or rail is used. The plural beams also provide a plurality of convenient handles for use in turning the patient. The use of a single beam simplifies the structure and reduces the possibility that there will be some interference between the necessary life support equipment and the structure of the prone positioner. The use of separate head and body rails as illustrated, for example, in FIG. 1, permits the device to be knocked down for storage and transportation. This also provides flexibility in adjusting the depth of the head pylons relative to the body pylons. Also, the width of the head pylons need not be the same as that of the body pylons with this arrangement.

In use the prone positioner is placed over the patient while the patient is in the prone position face up. The longitudinal positions of the various pylons are adjusted to fit the patient, locked in place and individually strapped to the patient. Care is taken to see that the stomach region of the patient's anatomy will be suspended substantially free of contact with the structure of this positioner as well as the underlying substrate when the patient is turned to the face down position. If the patient's stomach must unavoidably rest on something it should be in such a position that very little if any of the patient's weight is supported by the stomach.

In general, the head pylon 22 is positioned at the forehead and the head pylon 26 is positioned at the chin region of the patient. The upper torso pylon or block member is positioned so that it lies laterally across the patient's upper chest in the region of the shoulders, well above the stomach. The pelvic pylon 42 is positioned so that it lies laterally across the patient in the pelvic area, well clear of the stomach region. The straps 76 are applied at each location of the body block members and preferably also at the position of at least one of the head block members.

When the prone positioner is properly adjusted and securely strapped to the patient the rail or beam members may be grasped and the patient turned to a prone face down position. In the prone face down position the patient's stomach is suspended free of contact with the prone positioner as well as the underlying substrate so that breathing is greatly eased. The mounting of the prone positioner and the turning of the patient are accomplished with a minimum of labor and equipment.

It is observed in patients with adult respiratory distress syndrome that turning the patient prone face down while strapped to the prone positioner of this invention substantially increases the level of oxygen in the patient's blood and reduces the effort required of the patient to breath. Likewise, it is observed that the use of this prone positioner on a regular basis substantially reduces the risk of forming bed sores on permanently bed-ridden patients.

What has been described are preferred embodiments in which modifications and changes may be made without departing from the spirit and scope of the accompanying claims.

What is claimed is:

1. A prone patient positioner comprising:

rail means for holding a plurality of body support means in a predetermined operative position relative to the body of a prone patient, said rail means being adapted to extend generally longitudinally from about the head toward the feet of a human patient, said body support means including a plurality of body support members mounted on said rail means and adapted to support said patient in the prone position face down with the abdomen free of contact with the body support means and an underlying substrate, at least one of said body support members being adjustable relative to the others along said rail means to accommodate patients of different heights and proportions, each of said body support members including means for releasably securing said patient to said body support members and thus at least partially immobilize the patient while being turned together with said prone positioner between face up and face down positions.

2. A prone patient positioner of claim 1 wherein said body support members include padded pylon elements which are adapted to generally conform to the contours of the patients body.

3. A prone patient positioner of claim 1 wherein said rail means includes a pair of longitudinally extending rails, and said body support members extend generally laterally of said rails.

4. A prone patient positioner comprising:

a plurality of rail elements extending generally parallel to one another and adapted to extend from about the head of a prone patient toward the feet of said patient;

at least one head support block mounted on said rail elements, said head support block extending generally laterally of said rail elements, said head support block being adapted to support the head if said patient in the prone position;

an upper torso support block mounted on said rail elements, said upper torso support block extending generally laterally of said rail elements, said upper torso support block being adapted to support only the chest of said patient in the prone position;

a pelvic support block mounted on said rail elements, said pelvic support block extending generally laterally of said rail elements, said pelvic support block being adapted to support only the pelvic area of said patient in the prone position, said upper torso and pelvic support blocks being adapted to be positioned along said rail elements so as to leave the abdomen unsupported; and means for securing said prone patient positioner to a patient.

5. A prone patient positioner comprising:

a plurality of padded pylon members adapted to be positioned to support a prone patient face down with the abdomen suspended free between two of said pylon members;

a set of rails which extend generally parallel to one another for holding said padded pylon members in a predetermined configuration;

each of said padded pylon members being provided with strap means for strapping said prone patient positioner to the body of a patient for movement with the patient; and said padded pylon members being mounted transversely of said set of rails with at least two of said padded pylon members being positionable along said set of rails independently of the other said padded pylon members.

* * * * *